US010640945B1

(12) United States Patent
Niroumand

(10) Patent No.: US 10,640,945 B1
(45) Date of Patent: May 5, 2020

(54) SYSTEMS AND METHODS FOR MAKING COMPACTED AGGREGATE PIERS IN A SOIL MATRIX

(71) Applicant: Bahman Niroumand, Boushehr Port (IR)

(72) Inventor: Bahman Niroumand, Boushehr Port (IR)

( * ) Notice: Subject to any disclaimer, the term of this patent is extended or adjusted under 35 U.S.C. 154(b) by 0 days.

(21) Appl. No.: 16/403,015

(22) Filed: May 3, 2019

(51) Int. Cl.
*E02D 3/08* (2006.01)
*E02D 5/38* (2006.01)
*E02D 5/44* (2006.01)

(52) U.S. Cl.
CPC ..... *E02D 5/385* (2013.01); *E02D 5/44* (2013.01); *E02D 2250/0007* (2013.01); *E02D 2250/0023* (2013.01); *E02D 2300/0079* (2013.01)

(58) Field of Classification Search
CPC .. E02D 3/08; E02D 5/44; E02D 5/385; E02D 2250/0023
See application file for complete search history.

(56) References Cited

U.S. PATENT DOCUMENTS

2002/0009337 A1* 1/2002 Fox ..... E02D 3/08 405/232
2007/0077128 A1* 4/2007 Wissmann ..... E02D 3/046 405/232
2008/0101873 A1* 5/2008 Fox ..... E02D 5/44 405/239
2008/0193223 A1* 8/2008 Wissmann ..... E02D 3/08 405/229
2008/0205993 A1* 8/2008 Wissmann ..... E02D 3/08 405/232
2009/0290940 A1* 11/2009 Martin, Sr. ..... E02D 3/123 405/232
2011/0243666 A1* 10/2011 Fox ..... E02D 3/08 405/232
2013/0051927 A1* 2/2013 Kruse ..... E02D 13/10 405/233
2016/0186398 A1* 6/2016 Niroumand ..... E02D 1/00 405/50
2017/0058477 A1* 3/2017 Niroumand ..... E02D 5/62

* cited by examiner

*Primary Examiner* — Carib A Oquendo

(57) ABSTRACT

The present invention discloses a system and method for forming a compacted aggregate pier at a target location. The system comprises a mandrel, which is a composition of a casing pipe and an inner steel shaft with close ended cone and convenient entry and exit of the inner shaft. The system further comprises a casing is equipped with water jet system, a rammer of mandrel attached to hydraulic hammer and an inner mandrel with a casing pipe having two valves with open and close capability. Using this system, the matrix soil radial density and the bearing capacity and the modulus of the reaction of the composite soil are increased and soil settlement decreases. This system also increases the density of loose soils or soils with dense sandy intermediate layers especially in shores and rivers in submerged conditions. Also, the loose granular soil is retrofitted against liquefaction.

8 Claims, 12 Drawing Sheets

101
139
103
104
114
116
115
116
118
117
119

103
101
139
108
104
105
106
107
115
110
109
111
A
A
113
112
114

111
113
112
114
115
109
SECTION AA 118
117
114
119

SECTION BB

SECTION CC

SYSTEMS AND METHODS FOR MAKING COMPACTED AGGREGATE PIERS IN A SOIL MATRIX

BACKGROUND OF THE INVENTION

Recently, with the growth of urban and industrial areas, and the shortage of land and high-quality materials, demand for use of marginal lands is increasing. Additionally, techniques and equipment for improvement of loose and soft soil have been proposed. Generally, soft cohesive soils have two main characteristics, the first one is the low shear strength, and the second one is large settlement. Furthermore, loose granular soils have the great potential of liquefaction.

In the last few decades, compaction using sandy or gravelly columns, pile, piers, etc., has been conducted all over the world as a technical and an economical method. In practice, various methods of compacting gravelly piers were founded on one of the construction replacements, construction displacement, or combination methods. However, the final products, construction process, the configuration, and the effect on the relative density of gravel and matrix soil, which were constructed by each of the aforementioned methods, are very different. Generally, the gravel piers constructed by construction methods which are based on the type of loading, mechanical and physical characteristics of soil layers, and environmental conditions, are divided into multiple categories, for example, stone columns, compaction piles, rammed aggregate piers, etc.

Typically, stone columns are constructed by replacement of loose material with gravelly material by two methods of vibrating replacement and vibrating compaction. Compaction piles are constructed based on displacement mechanism by means of excavating a hole in the ground and making a radial compaction for the surrounding soil and filling it by sandy or gravelly material by two methods of sand compaction piles and gravel compaction piles. Rammed aggregate piers are made of methods based on the combination of replacement and displacement, and by means of excavating a hole by mechanical auger, filling it by gravelly material and making a radial compaction in the layers.

The present disclosure relates to an excavation process, and more particularly relates to a system and method for forming a compacted aggregate pier at a target location. The technologies and processes offered in the prior art perform in loose and coastal submerged soils. However, the mandrel accidently collides in its path with a very dense sandy intermediate layer which will result in the creation of tolerance beyond the main objectives of this method. On the other hand, the cost and the implementation time would increase. Moreover, assuming cross through the intermediate layer by the primary hole, the operation of gravel compaction into the well by the long penetrating tamper will be challenged especially in the lower half of pier due to the difficulty in pulling up the mandrel.

Therefore, there is need for an improved system and method for making gravel impact compaction piers, which increase the density of loose soils or soils with dense sandy intermediate layers especially in shores and rivers, in submerged conditions, and increase the bearing capacity and the subgrade reaction modulus and decrease the soil settlement.

SUMMARY OF THE INVENTION

Systems and methods for forming a compacted aggregate pier at a target location are disclosed.

In one embodiment, the system comprises a mandrel for forming a compacted aggregate pier at a target location. The mandrel comprising a casing having a hollow cylindrical configuration, a drive shaft, a rammer element, and an inner mandrel with a housing. The drive shaft is disposed within the casing comprises a first end and a second end. The first end comprises an inner ring mounted on the drive shaft and an outer cylinder connected to the inner ring via one or more plates. The first end could detachably lock with the casing via a locking assembly, and the second end of the drive shaft is enclosed by a bore head. In one embodiment, an exterior surface of the casing comprises, but not limited to, a L-shaped steel section enclose a galvanized pipe for pumping water to an end nozzle disposed at the casing to cross through dense sandy intermediate layer.

In one embodiment, the rammer element is connected to a hammer element to transmit impact of the hammer element to the drive shaft. In one embodiment, the rammer element comprises a flat surface with a decreasing tapered form from top to bottom end. The hammer element is configured to transmit the impact to the bore head positioned at the second end of the drilling shaft to form the cavity at the target location. In one embodiment, the bore head is of one of, but not limited to, a conical configuration and a pyramidal configuration.

In one embodiment, the inner mandrel with the housing having a hollow cylindrical configuration, the housing comprises a first end and a second end. In one embodiment, the first end is configured to detachably lock with the first end of the casing after detaching the drive shaft. The second end of the housing comprises at least two valves with open and close capability configured to discharge the aggregate at the target location, and the inner mandrel is rammed with the hammer element after closing the valves for creating compacted aggregate layer. In one embodiment, the target location could be selected from a group consisting of, but not limited to, a loose sandy soil, a clayey soil, a medium density soil, and a soil bed having hard rocks.

In one embodiment, an aggregate pier compaction system for forming a compacted aggregate pier at a target location is disclosed. The system comprises a mandrel, a casing, a drive shaft, a rammer element, and an inner mandrel. In one embodiment, the mandrel could form a cavity at a target location. The casing includes a hollow cylindrical configuration. In one embodiment, the drive shaft could be disposed within the casing. The casing further comprises a first end and a second end. The first end of the casing comprises an inner ring mounted on the drive shaft and an outer cylinder connected to the inner ring via one or more plates. The first end detachably locks with the casing via a locking assembly, and the second end of the drive shaft is enclosed by a bore head. In one embodiment, the bore head is of one of, but not limited to, a conical configuration and a pyramidal configuration. The bore head is configured in a wedge shape to bore through hard rock surfaces.

In one embodiment, the rammer element is connected to a hammer element to transmit impact of the hammer element to the drive shaft, wherein the drive shaft is configured to drive the casing onto the target location to form the cavity. The rammer element comprises a flat surface with a decreasing tapered form from top to bottom end.

In one embodiment, the inner mandrel includes a housing with a hollow cylindrical configuration. The housing of the inner mandrel comprises a first end and a second end. The first end is configured to detachably lock with the first end of the casing and the second end comprises an interior cylinder. The first end is configured to detachably lock with the first end of the casing and the second end comprises an interior cylinder.

In one embodiment, the interior cylinder comprises a steel plate, driver plates, and a valve. The steel plate vertically extends across a length of the cylinder and the divider plates vertically extend from each side of the first plate to the cylinder. In one embodiment, the valve could be disposed below the divider plates and extends horizontally across the passage from each side of the first plate dividing the cylinder into number of passages. The valve could be disposed below the passages and configured to open and close for controlling the flow of aggregate.

In one embodiment, the inner mandrel is disposed within the casing after detaching the drive shaft to fill the housing with aggregate. The valve is configured to discharge the aggregate at the target location and ram the inner mandrel with the hammer element after closing the valves for creating compacted aggregate layer. In one embodiment, one or more chains steel chains are disposed below the valve to avoid soil bulking and closing of the valves and to help in opening of end valves.

In one embodiment, the system further comprises a tamper device with a compacting shaft for compacting the filled aggregate. The compacting shaft comprising a first end and a second end, and a second hammer element. The second hammer element is extended from the first end of the compacting shaft for receiving multiple impacts from an external vibratory hammer and transferring the impact to a compaction head positioned at the second end of the compacting shaft for forming the compacted aggregate pier at the target location.

In one embodiment, the system further comprises a finishing tamper device. The finishing tamper device comprises a shaft having a first end and a second end and a third hammer element. The third hammer element could be extended from the first end of the shaft for receiving multiple impact from the external vibratory hammer and transferring the impact to a finishing head positioned at the second end of the shaft for compacting a top layer of the compacted aggregate pier to form a finished aggregate pier at the target location. In one embodiment, the system further comprises one or more vertical steel plates is connected to the steel plate in order to hold the valve oblique and for ease of closure.

In one embodiment, an aggregate impact compaction pier method for forming a compacted aggregate pier at a target location is disclosed. At one step, the mandrel is position above the target location. At another step, a cavity is generated by driving the mandrel using an external vibratory hammer. At another step, the drive shaft is removed from the casing of the mandrel positioned in the cavity. At another step, the inner mandrel is placed into the casing of the mandrel. At another step, the hollow cylindrical configuration of the housing of the inner mandrel is filled with aggregate. At another step, the casing of the mandrel is removed. At another step, the aggregate is discharged at the target location by raising the housing of the mandrel to a predefined distance and opening the valves. At another step, the inner mandrel with the hammer element is rammed after closing the valves for creating an end resistant bulb. At another step, the step of discharging and driving to form a compacted aggregate layer of predefined thickness is repeated. At another step, the aggregate filled cavity is compacted at least once using the tamper device. Further, at step, a top layer of the compacted aggregate pier with the finishing tamper device is compacted to form a finished aggregate pier at the target location.

One aspect of the present disclosure is directed to a mandrel for forming a compacted aggregate pier at a target location, the mandrel comprising: (a) a casing having a hollow cylindrical configuration; (b) a drive shaft disposed within the casing comprises a first end and a second end, wherein the first end comprises an inner ring mounted on the drive shaft and an outer cylinder connected to the inner ring via one or more plates, the first end detachably locks with the casing via a locking assembly, and the second end of the drive shaft is enclosed by a bore head; (c) a rammer element connected to a hammer element to transmit impact of the hammer element to the drive shaft, wherein the hammer element is configured to transmit the impact to a bore head positioned at the second end of the drilling shaft to form the cavity at the target location; and (d) an inner mandrel with a housing having a hollow cylindrical configuration, the housing comprises a first end and a second end, wherein the first end is configured to detachably lock with the first end of the casing after detaching the drive shaft and the second end comprising at least two valves with open and close capability configured to discharge the aggregate at the target location, and the inner mandrel is rammed with the hammer element after closing the valves for creating compacted aggregate layer.

In one embodiment, the rammer element comprises a flat surface with a decreasing tapered form from top to bottom end. In another embodiment, the bore head comprises at least one of one of a conical configuration and a pyramidal configuration. In one embodiment, an exterior surface of the casing comprises a L-shaped steel section enclose a galvanized pipe for pumping water to an end nozzle disposed at the casing to cross through dense sandy intermediate layer. In another embodiment, the target location is selected from a group consisting of a loose sandy soil, a clayey soil, a medium density soil, and a soil bed having hard rocks.

Another aspect of the present disclosure is directed to an aggregate pier compaction system for forming a compacted aggregate pier at a target location, the system comprising: (a) a mandrel comprising a casing having a hollow cylindrical configuration, a drive shaft disposed within the casing comprises a first end and a second end, wherein the first end comprises an inner ring mounted on the drive shaft and an outer cylinder connected to the inner ring via one or more plates, the first end detachably locks with the casing via a locking assembly, and the second end of the drive shaft is enclosed by a bore head, and a rammer element connected to a hammer element to transmit impact of the hammer element to the drive shaft, wherein the drive shaft is configured to drive the casing onto the target location to form the cavity; (b) an inner mandrel with a housing having a hollow cylindrical configuration, the housing comprises a first end and a second end, the first end is configured to detachably lock with the first end of the casing and the second end comprising an interior cylinder, the interior cylinder comprises a steel plate vertically extends across a length of the cylinder, a divider plates vertically extends from each side of the first plate to the cylinder and a valve disposed below the divider plates and extends horizontally across the passage from each side of the first plate dividing the cylinder into number of passages, wherein the valve disposed below the passages is configured open and close to control the flow of aggregate, and the inner mandrel is disposed within the casing after detaching the drive shaft to fill the housing with aggregate, the valve is configured to discharge the aggregate at the target location and ram the inner mandrel with the hammer element after closing the valves for creating compacted aggregate layer; (c) a tamper device for compacting the filled aggregate comprising a compacting shaft comprising a first end and a second end, a second hammer element extending from the first end of the compacting shaft for receiving multiple impacts from an external vibratory hammer and transferring the impact to a compaction head positioned at the second end of the compacting shaft for forming the compacted aggregate pier at the target location; and (d) a finishing tamper device comprising a shaft, the shaft comprising a first end and a second end, a third hammer element extending from the first end of the shaft for receiving multiple impact from the external vibratory hammer and transferring the impact to a finishing head positioned at the second end of the shaft for compacting a top layer of the compacted aggregate pier to form a finished aggregate pier at the target location.

In one embodiment, an exterior surface of the casing comprises a L-shaped steel section enclose a galvanized pipe for pumping water to an end nozzle disposed at the casing. In another embodiment, the system further comprises one or more chains steel chains disposed below the valve to avoid soil bulking and closing of the valves and to help in opening of end valves. In one embodiment, the system further comprises one or more vertical steel plates is connected to the steel plate in order to hold the valve oblique and for ease of closure.

Another aspect of the present disclosure is directed to an n aggregate impact compaction pier method for forming a compacted aggregate pier at a target location, comprising the step of: (a) providing an aggregate impact compaction pier system comprising: a mandrel comprising (i) a casing having a hollow cylindrical configuration, a drive shaft disposed within the casing comprises a first end and a second end, the first end comprises an inner ring mounted on the drive shaft and an outer cylinder connected to the inner ring via one or more plates, the first end detachably locks with the casing via a locking assembly, and the second end of the drive shaft is enclosed by a bore head, and a rammer element connected to a hammer element to transmit impact of the hammer element to the drive shaft, wherein the drive shaft is configured to drive the casing onto the target location to form the cavity; (ii) an inner mandrel with a housing having a hollow cylindrical configuration, the housing comprises a first end and a second end, the first end is configured to detachably lock with the first end of the casing and the second end comprising an interior cylinder, the interior cylinder comprises a steel plate vertically extends across a length of the cylinder, a divider plates vertically extends from each side of the first plate to the cylinder and a valve disposed below the divider plates and extends horizontally across the passage from each side of the first plate dividing the cylinder into number of passages, wherein the valve disposed below the passages is configured open and close to control the flow of aggregate, and the inner mandrel is disposed within the casing after detaching the drive shaft to fill the housing with aggregate, the valve is configured to discharge the aggregate at the target location, and the inner mandrel is rammed with the hammer element after closing the valves for creating compacted aggregate layer, (iii) a tamper device for compacting the filled aggregate comprising a compacting shaft comprising a first end and a second end, a second hammer element extending from the first end of the compacting shaft for receiving multiple impacts from an external vibratory hammer and transferring the impact to a compaction head positioned at the second end of the compacting shaft for forming the compacted aggregate pier at the target location, and (iv) a finishing tamper device comprising a shaft, the shaft comprising a first end and a second end, a third hammer element extending from the first end of the shaft for receiving multiple impact from the external vibratory hammer and transferring the impact to a finishing head positioned at the second end of the shaft for compacting a top layer of the compacted aggregate pier to form a finished aggregate pier at the target location; (b) positioning the mandrel above the target location; (c) generating a cavity by driving the mandrel using an external vibratory hammer; (d) removing the drive shaft from the casing of the mandrel positioned in the cavity; (e) placing the inner mandrel into casing of the mandrel; (f) filing the hollow cylindrical configuration of the housing of the inner mandrel with aggregate; (g) removing the casing of the mandrel; (h) discharging the aggregate at the target location by raising the housing of the mandrel to a predefined distance and opening the valves; (i) driving the inner mandrel with the hammer element after closing the valves for creating an end resistant bulb; (j) repeating the step of discharging and driving to form a compacted aggregate layer of predefined thickness; (k) compacting the aggregate filled cavity at least once using the tamper device, and (l) compacting a top layer of the compacted aggregate pier with the finishing tamper device to form a finished aggregate pier at the target location.

In one embodiment, an exterior surface of the casing comprises a L-shaped steel section enclose a galvanized pipe for pumping water to an end nozzle disposed at the casing. In another embodiment, the method further comprises one or more chains steel chains disposed below the valve to avoid soil bulking and closing of the valves and to help in opening of end valves. In one embodiment, the method further comprises one or more vertical steel plates is connected to the steel plate in order to hold the valve oblique and for ease of closure. In one embodiment, the rammer element comprises a flat surface with a decreasing tapered form from top to bottom end. In another embodiment, the bore head comprises at least one of a conical configuration and a pyramidal configuration. In one embodiment, the target location is selected from a group consisting of a loose sandy soil, a clayey soil, a medium density soil, and a hard rock soil bed. In a related embodiment, the target location is selected from a group consisting of a loose sandy soil, a clayey soil, a medium density soil, and a soil bed having hard rock.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

The present invention generally relates to an excavation process, and more particularly relates to a system and method for forming a compacted aggregate pier at a target location. The gravel impact compaction piers system is one of the soil improvement methods, especially for loose and saturated soils in coastal areas. The construction method involves drilling of compressible soil and replacing with the selected material such as gravel. The gravel is rammed into dense compacted lifts that expand the drilled cavity. The cavity expansion effect increases soil strength and stiffness, resulting in higher bearing capacity and reduced soil compressibility. Few existing patent applications disclosing a system for forming aggregate piers are discussed as follows.

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figures 1A, 1B, 1C, 1D:
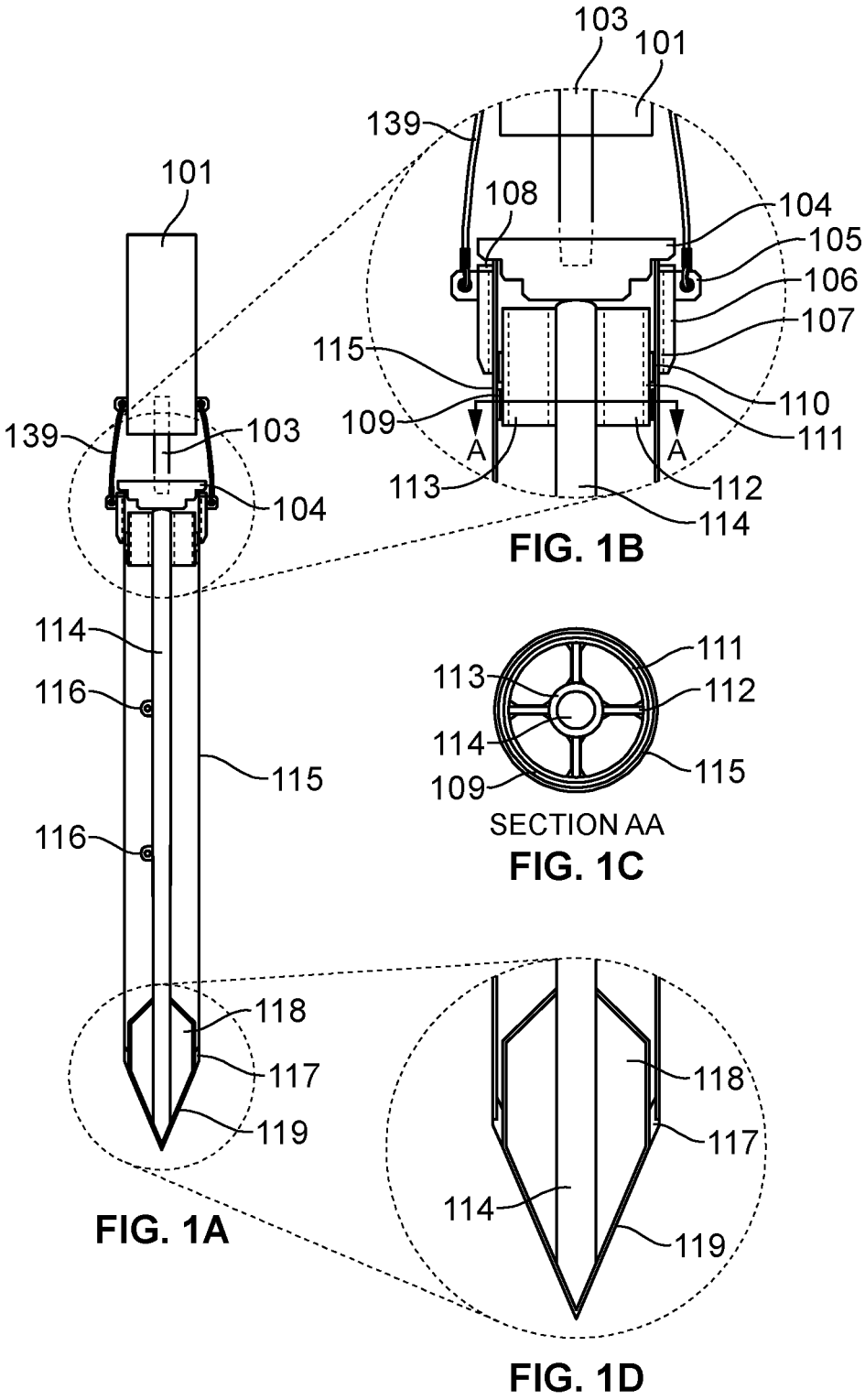
FIG. 1A illustrates a longitudinal section of main components of the mandrel and rammer of mandrel, according to an embodiment of the present invention.
FIG. 1B illustrates an enlarged view of upper part of mandrel and rammer of mandrel, according to an embodiment of the present invention.
FIG. 1C illustrates a cross section of upper part of mandrel, according to an embodiment of the present invention.
FIG. 1D illustrates an enlarged view of bottom part of mandrel, according to an embodiment of the present invention.

Referring to FIG. 1A, the mandrel for forming an aggregate pier at a target location comprises a casing 115, a drive shaft 114, a rammer element 104 and a hammer element 101. The casing 115 comprises a generally hollow cylindrical configuration for housing the drive shaft 114. In one embodiment, the hammer element 101 is a hydraulic hammer. In one embodiment, the rammer element 104 double edged flat steel disk. In one embodiment, the rammer element 104 comprises a flat surface with a decreasing tapered form from top to bottom end.

The drive shaft 114 comprises a first end and a second end. A rammer element 104 is configured to receive multiple impacts from the hammer element 101 and transmit to the first end of the drive shaft 114. The rammer element 104 is coupled to the hammer element 101 via a shaft. The first end of the drive shaft 114 is detachably attached to the casing 115 via a locking assembly for transferring the impact to a second end of the drive shaft 114. In one embodiment, at least two rings made of steel 116 are disposed at the drive shaft 114 for transporting the drive shaft 114.

Referring to FIG. 1A to FIG. 5C, the first end of the drive shaft 114 comprises an inner ring 113 and an outer cylinder 111 connected to the inner ring 113 via one or more shear steel plates 112. The steel plates 112 is configured to transfer load between the inner ring 113 and the outer cylinder 111. An incomplete ring 110 is welded to the exterior side of the outer cylinder 111.

Figures 4A, 4B:
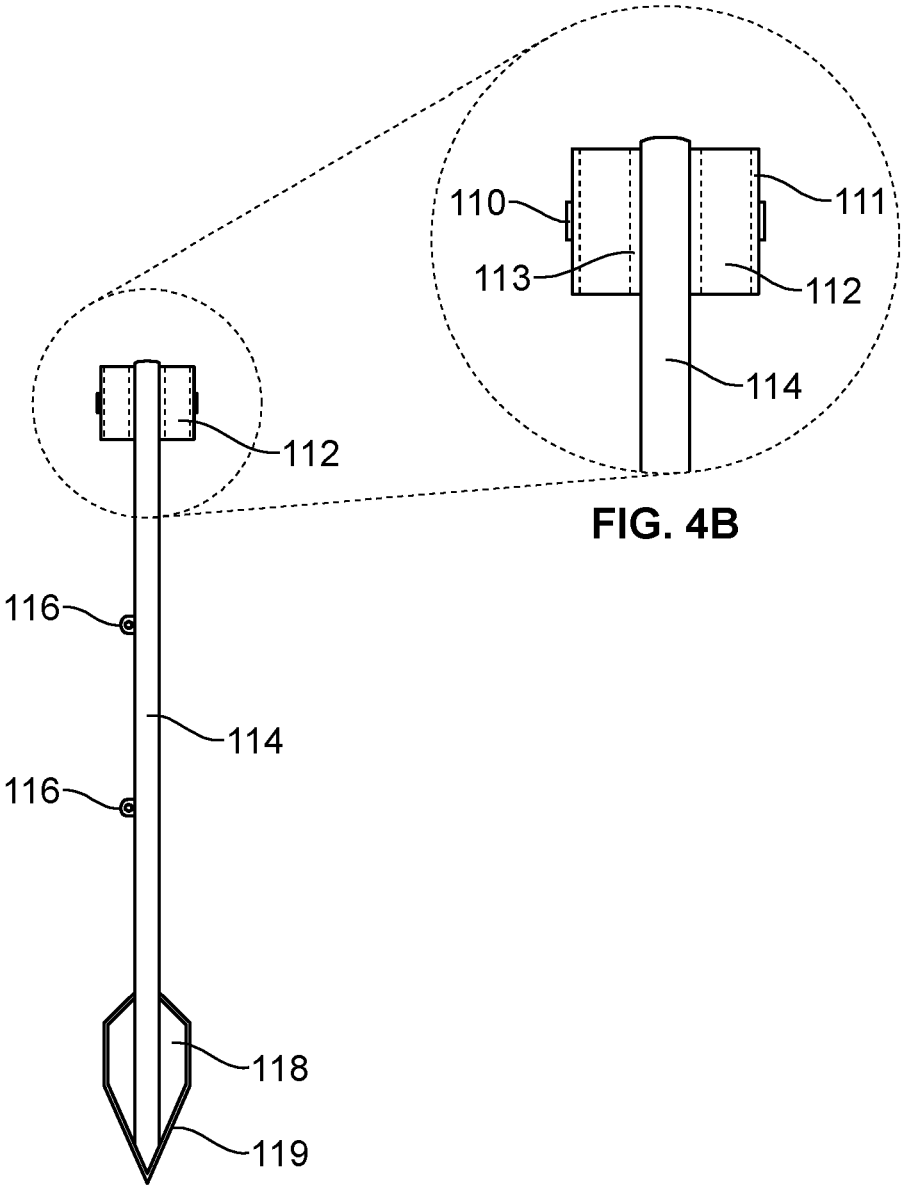
FIG. 4A illustrates a longitudinal section of drive shaft of mandrel, according to an embodiment of the present invention.
FIG. 4B illustrates an enlarged view of upper part of drive shaft of mandrel, according to an embodiment of the present invention.
Figures 5A, 5B, 5C:
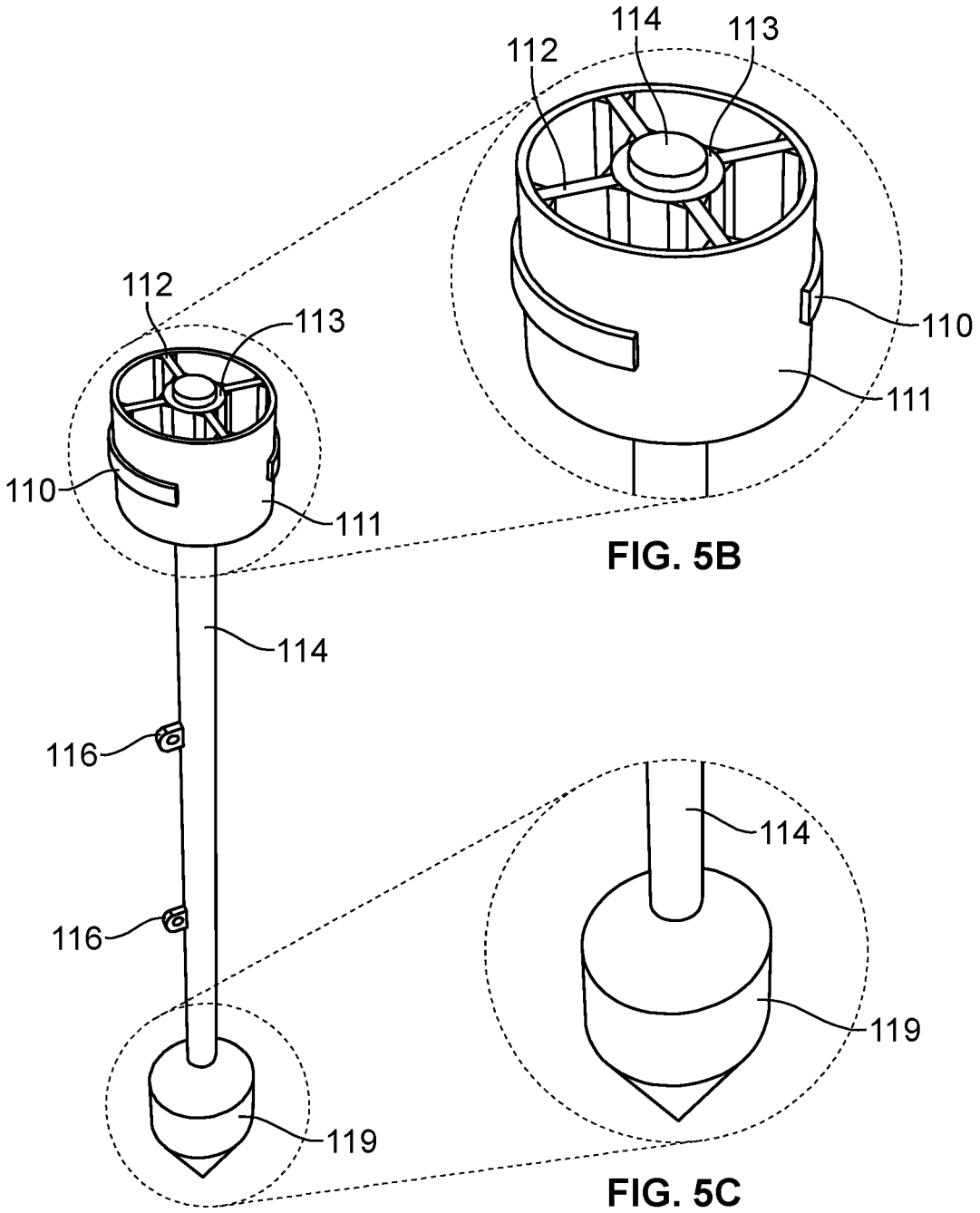
FIG. 5A illustrates a 3D view of drive shaft of mandrel, according to an embodiment of the present invention.
FIG. 5B illustrates an enlarged view of upper part of drive shaft of mandrel, according to an embodiment of the present invention.
FIG. 5C illustrates an enlarged view of bottom part of drive shaft of mandrel, according to an embodiment of the present invention.

Referring to FIG. 1A, FIG. 4A and FIG. 1D, the second end of the shaft 114 comprises a bore head 119 to generate a cavity at the target location. In one embodiment, the bore head 119 is a conical shell. In one embodiment, a hardening steel ring is provided at a bottom interior portion of the casing. In one embodiment, a steel plate 118 is provided to connect the drive shaft 114 and the conical shell for completing the cone shaped shell.

Referring to FIG. 1B and FIG. 1C, at least four rings 105 made of steel are welded to an exterior upper portion of the casing 115. The at least four rings 105 supports to carry the casing 115. The casing assembly further comprises a hardener assembly. The hardener assembly is disposed at the exterior upper portion of the casing 115. The hardener assembly comprises at least six vertical plates 106 and at least six hardening plates 107 arranged alternatively. Further, a horizontal ring 108 is disposed at the upper portion of the casing 115 to provide a hardened edge against the impacts from the rammer element 104. The at least six vertical plates 106 is disposed around the casing, connected to the horizontal ring 108 and the casing 115. At least six hardening plates 107 are connected to the casing wall and between the vertical plates 106 and horizontal ring 108.

Figure 2B:
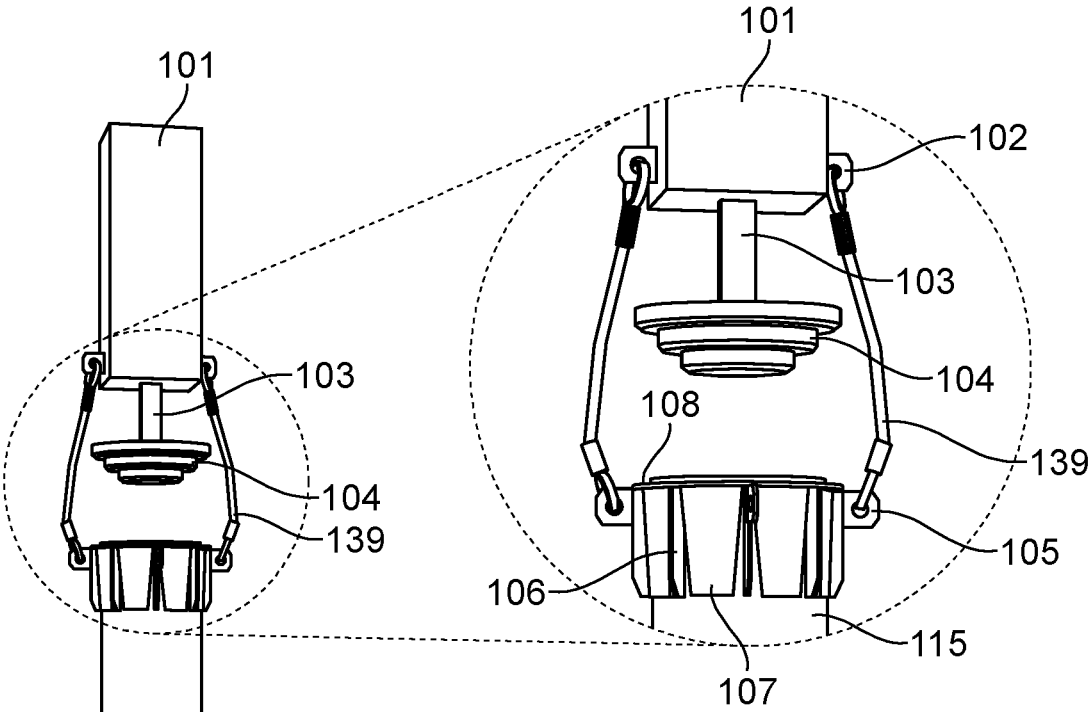
FIG. 2B illustrates an enlarged view of upper part of mandrel and rammer of mandrel, according to another embodiment of the present invention.
Figure 2A:
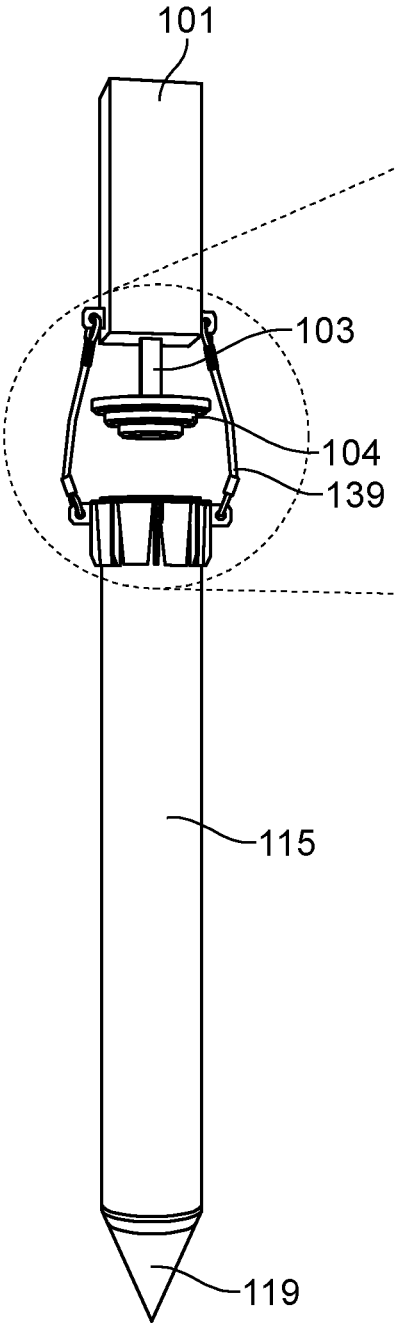
FIG. 2A illustrates a 3D view of mandrel and rammer of mandrel, according to an embodiment of the present invention.

FIG. 2A and FIG. 2B illustrates a 3D view of mandrel and rammer element 104 of the mandrel. At least rings 102 are welded to the hammer element 101 is connected to the at least four rings 105 at the exterior upper portion of the casing 115 via one or more cables 139. The at least rings 102, at least four rings 105 and one or more cables 139 enables to lift various components of the mandrel.

Figure 3B:
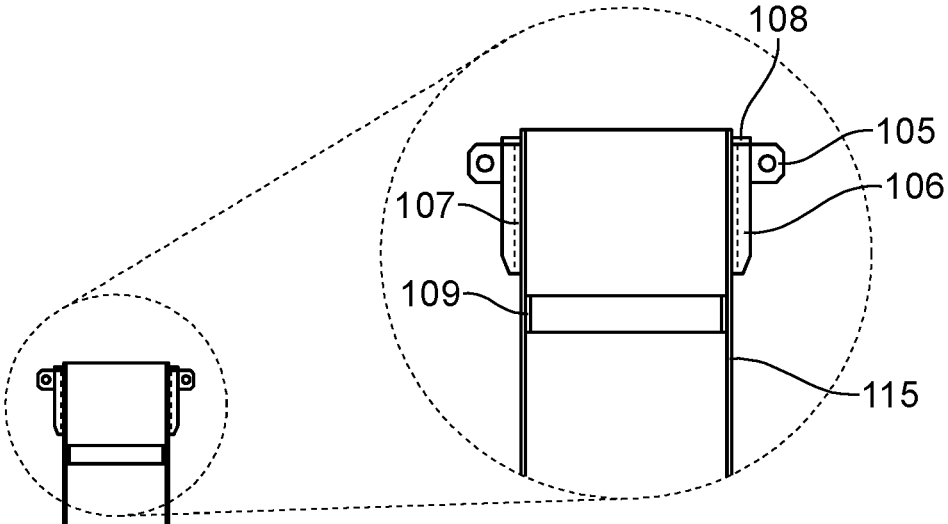
FIG. 3B illustrates an enlarged view of upper section of casing pipe of mandrel, according to an embodiment of the present invention.
Figure 3A:
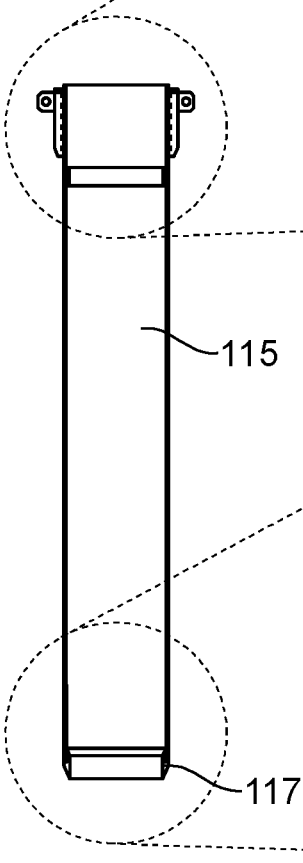
FIG. 3A illustrates a longitudinal section of casing pipe of mandrel, according to an embodiment of the present invention.
Figure 3C:
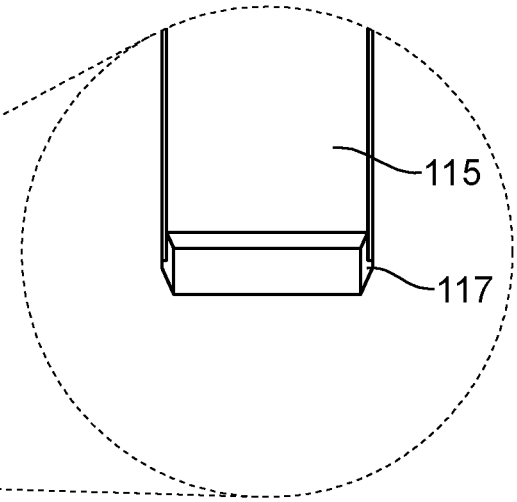
FIG. 3C illustrates an enlarged view of end section of casing pipe of mandrel, according to an embodiment of the present invention.

FIG. 3A and FIG. 3C illustrate the longitudinal section of casing 115 of mandrel includes casing 115 and the hardening steel ring 117. Referring to FIG. 1A to FIG. 3B, an interior upper portion of the casing 115 comprises a steel ring 109. Referring to FIG. 1B to FIG. 1C, the incomplete ring 110 at the outer cylinder 111 is configured to lock with the steel ring 109 at the interior upper portion of the casing 115, forming a first locking assembly.

Figures 6A, 6B:
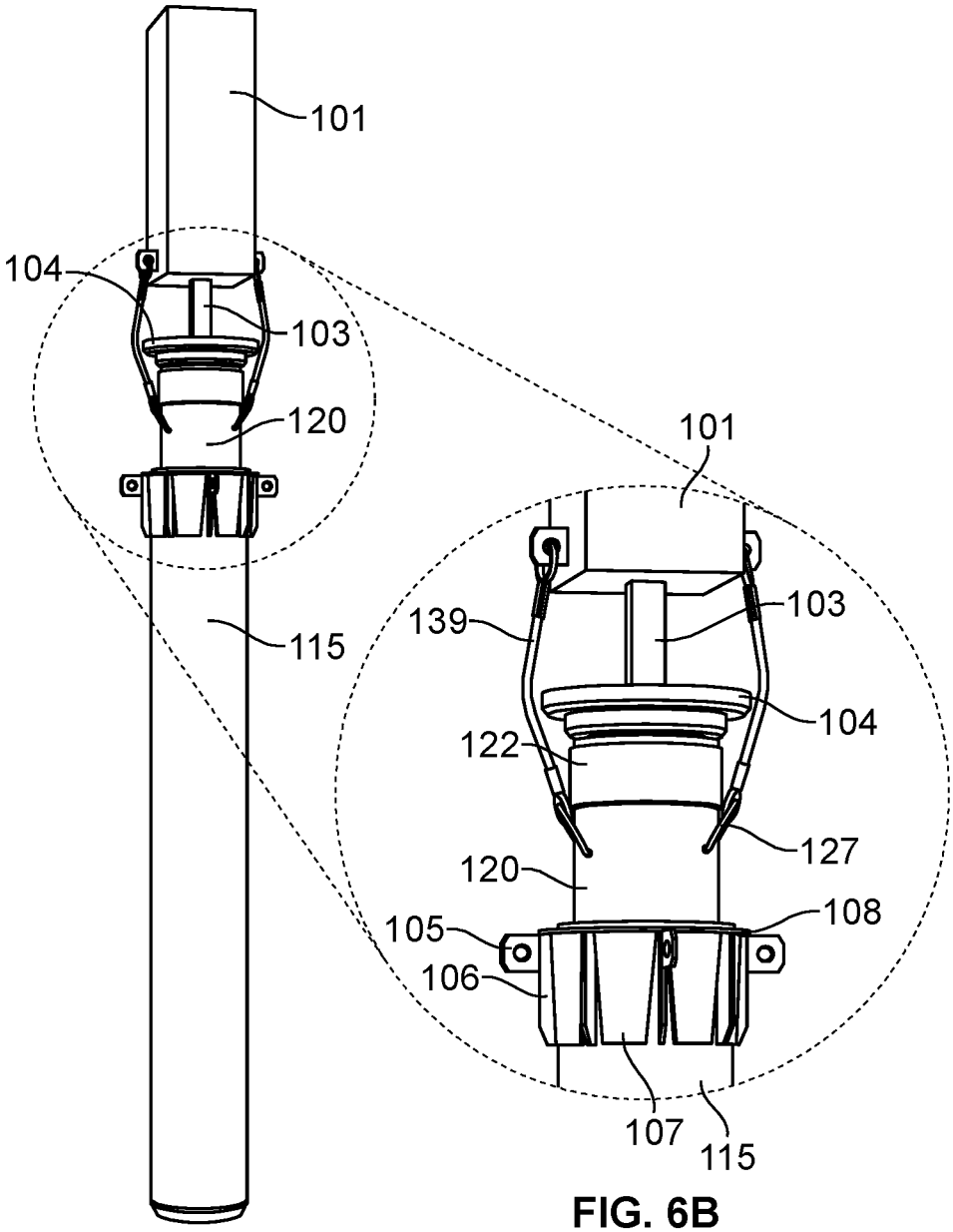
FIG. 6A illustrates a 3D view of inner mandrel inside the casing pipe of outer mandrel and rammer of mandrels, according to an embodiment of the present invention.
FIG. 6B illustrates an enlarged view of upper part of inner mandrel inside casing pipe of outer mandrel and rammer of mandrels, according to an embodiment of the present invention.

FIG. 6A and FIG. 6B illustrates a 3D view of inner mandrel inside the casing 115 of the mandrel and rammer 104 of mandrels. The inner mandrel comprises a housing 120 having a hollow cylindrical configuration. The housing 120 comprises a first end and a second end. The first end comprises a vertical outer ring 122 configured to harden the edge of the housing of the inner mandrel. At least four closed loops 127 are disposed at the first end below the vertical outer ring 122.

Figures 7A, 7B, 7C:
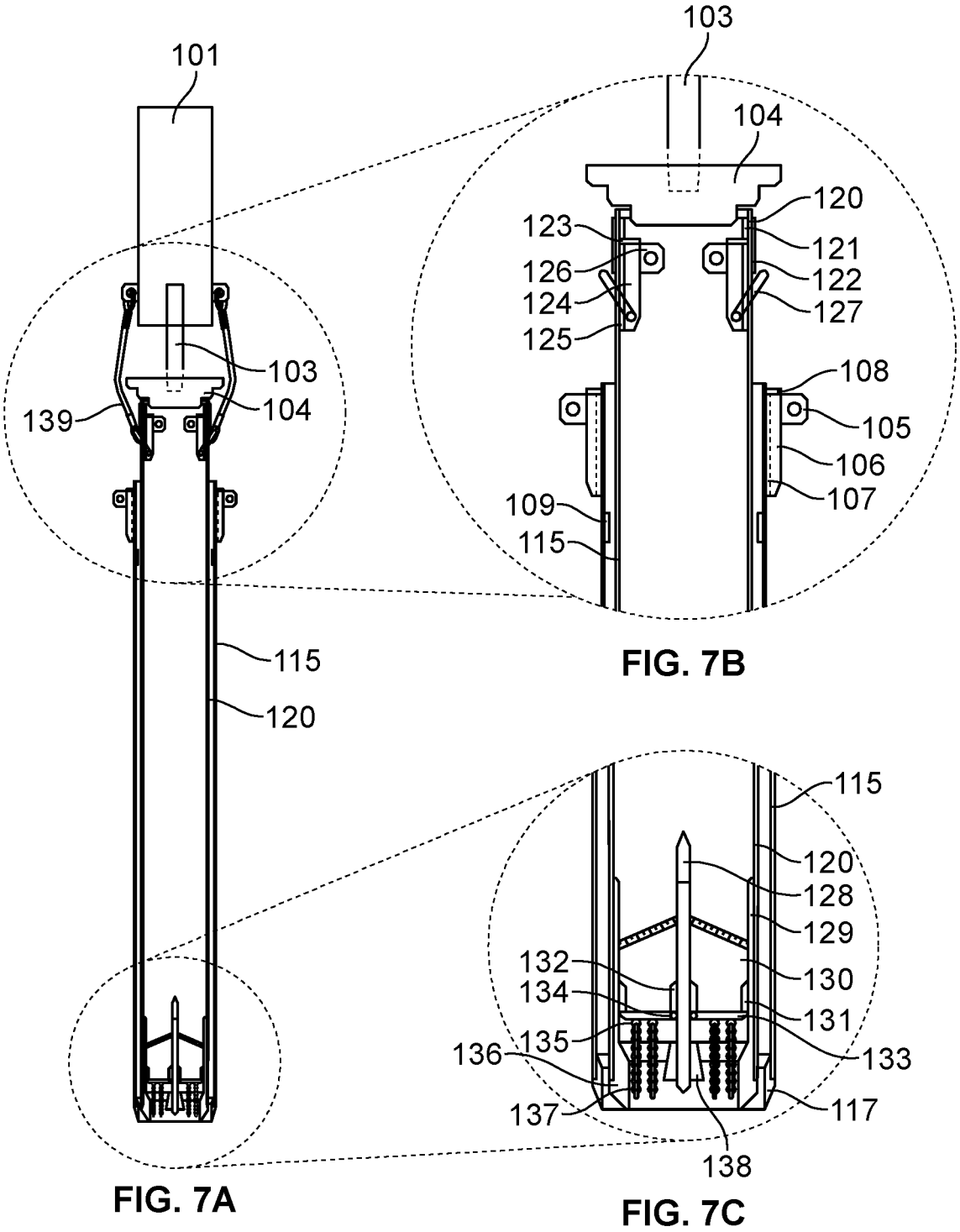
FIG. 7A illustrates an enlarged view of an inner mandrel in casing of the mandrel and rammer of mandrel, according to an embodiment of the present invention.
FIG. 7B illustrates an enlarged top view of the inner mandrel in the inside of casing of the mandrel and rammer of mandrel, according to an embodiment of the present invention.
FIG. 7C illustrates an enlarged bottom view of the inner mandrel in the mandrel and rammer of mandrels, according to an embodiment of the present invention.

FIG. 7A to FIG. 9D exemplarily illustrates different views of the inner mandrel according to various embodiments of the present invention. Referring to FIG. 7A and FIG. 7B, the first end of the housing 120 comprises a vertical ring 121 disposed at the interior side of the housing 120 for hardening the housing edge of the inner mandrel. A horizontal ring 123 is disposed below the vertical ring 121 at the interior side of the housing 120 for hardening the housing edge of the inner mandrel.

Further, a vertical steel plates 124 and a hardening steel plates 125 is disposed at the at the interior side of the housing 120 for hardening the first end of the inner mandrel. The hardening steel plates are attached to the housing at the interior side and between the horizontal steel ring 123 and the vertical steel plates 124. Further, four inner rings 126 are attached to the vertical steel plates for moving the inner mandrel.

Referring to FIG. 7C, the second end of the housing 120 comprises a horizontal steel cylinder 129. A vertical steel plate 128 is configured to extend across the entire length of the horizontal steel cylinder 129. A divider plate 130 vertically extends from each side of the vertical steel plate 128 to the cylinder 129 to form one or more passages. A valve 134 disposed below the divider plate 130 and extends horizontally across the passage from each side of the vertical steel plate 128 to the horizontal steel cylinder 129. The valve 134 is configured with sequential opening and closing capabilities in accordance with the vertical displacement of the mandrel.

At least four steel plates 132 are connected to the vertical steel plate 128 as a support for hinge of the end valves 133. A hinge 134 of the valve 134 is connected to the vertical steel plate 128. one or more steel rings 135 are disposed below the end valves 134 to connect with one or more steel chains 137. The chains 137 are connected to the end valves 134 in order to avoid soil bulking and closing of the valves 134 and to help in opening of end valves 134. A vertical steel plates 138 is connected to the steel plate 128 in order to hold the end valve 134 oblique and for ease of closure. A thick steel ring 136 having a beveled end is formed monolith to the horizontal steel cylinder 129. In one embodiment, the thickness of the thick steel ring 136 is greater than the horizontal steel cylinder 129.

Figure 8A:
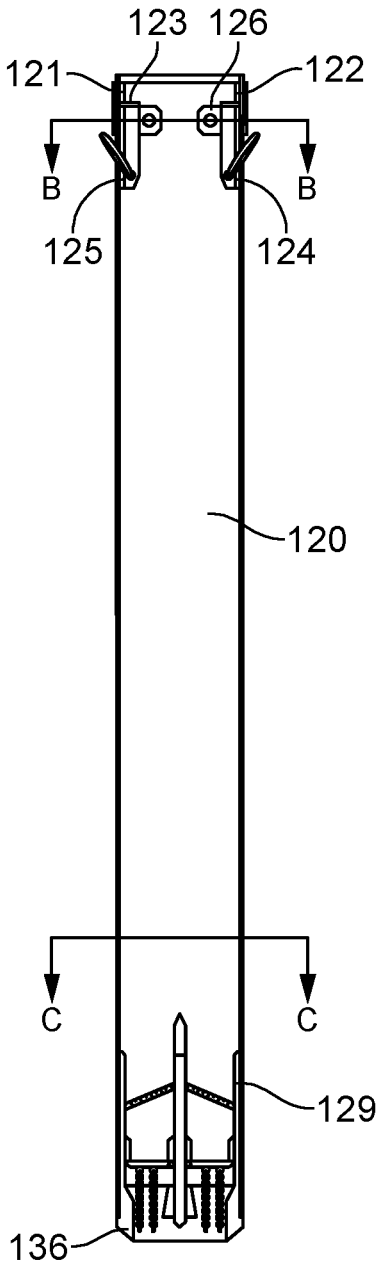
FIG. 8A illustrates an enlarged view of a longitudinal section of the housing of the inner mandrel, according to an embodiment of the present invention.
Figure 8B:
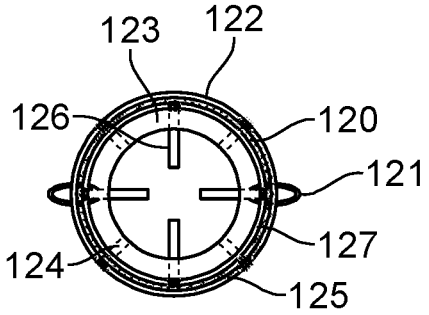
FIG. 8B illustrates an enlarged cross-sectional view of the upper part of the housing of the inner mandrel, according to an embodiment of the present invention.
Figure 8C:
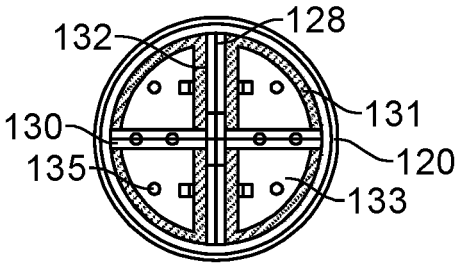
FIG. 8C illustrates an enlarged cross-sectional view of an end part of the housing of the inner mandrel, according to an embodiment of the present invention.

FIG. 8A illustrates a longitudinal section of casing pipe of the inner mandrel include housing 120, vertical outer ring 122, horizontal ring 123, vertical steel plates 124, hardening steel plates 125, horizontal steel cylinder 129 and a thick steel ring 136. FIG. 8B illustrates enlarged details of cross section of upper part of casing pipe of the inner mandrel comprising housing 120, vertical link 121, vertical outer ring 122, horizontal steel ring 123, vertical steel plates 124, hardening steel plates 125, four inner rings 126 and at least four closed loops 127. FIG. 8C illustrates enlarged details of cross section of end part of casing pipe of the inner mandrel includes housing 120, vertical steel plate 128, divider plate 130, at least four steel plates 132, end valves 133 and one or more steel rings 135.

Figures 9A, 9B, 9C, 9D:
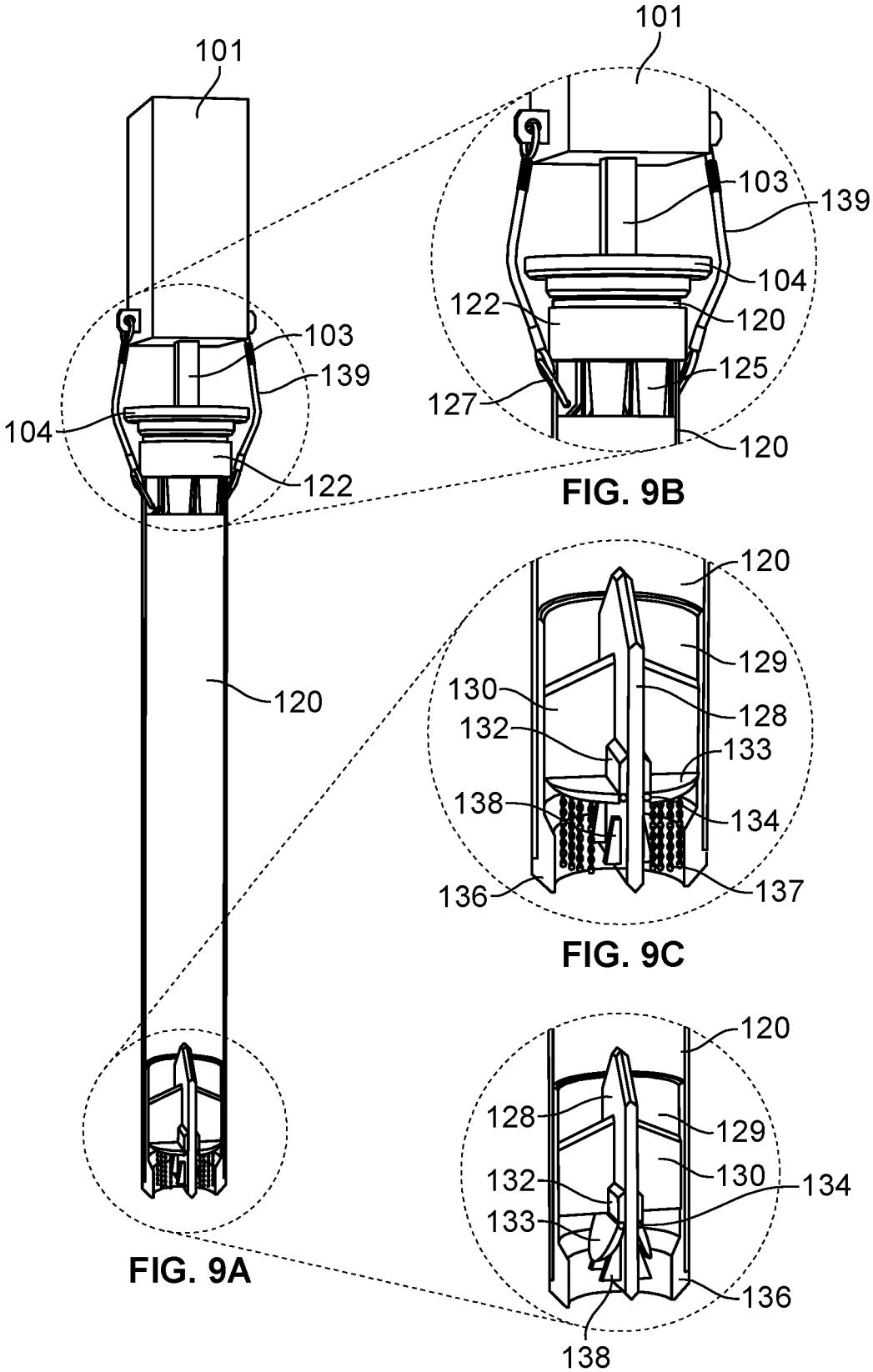
FIG. 9A illustrates a 3D view of a longitudinal section of the inner mandrel and the rammer of mandrels, according to an embodiment of the present invention.
FIG. 9B illustrates a 3D view of the longitudinal section of the upper part of the inner mandrel and the rammer of mandrel, according to an embodiment of the present invention.
FIG. 9C illustrates a 3D view of the longitudinal section of end of the inner mandrel, according to an embodiment of the present invention.
FIG. 9D illustrates a 3D view of the longitudinal section of the inner mandrel in the open valves without displaying chains connected to the valves, according to an embodiment of the present invention.

FIG. 9A exemplarily illustrates a 3D view of longitudinal section of the inner mandrel and the rammer element 104 of mandrels in an embodiment of the present invention. FIG. 9B exemplarily illustrates a 3D view of enlarged details of longitudinal section of upper part of the inner mandrel and the rammer 104 of mandrel includes hammer element 101, drive shaft 103, rammer element 104, housing 120, vertical outer ring 122, hardening steel plates 125, at least four closed loops 127 and one or more cables 139.

FIG. 9C illustrates 3D view of enlarged details of longitudinal section of end of the inner mandrel includes housing 120, vertical steel plate 128, horizontal steel cylinder 129, divider plate 130, at least four steel plates 132, end valves 133, valve 134, a thick steel ring 136, one or more steel chains 137 and vertical steel plates 138.

FIG. 9D illustrates 3D view of enlarged details of longitudinal section of end of the inner mandrel in the open valves without displaying chains connected to the valves includes housing 120, vertical steel plate 128, horizontal steel cylinder 129, divider plate 130, 131, at least four steel plates 132, end valves 133, valve 134, one or more steel rings 135, a thick steel ring 136, one or more steel chains 137, vertical steel plates 138 and one or more cables 139.

Figure 10A:
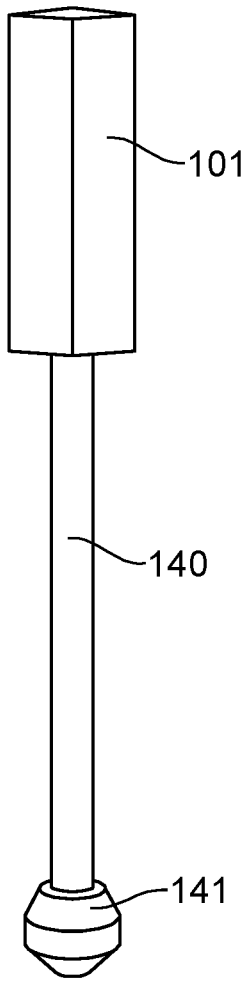
FIG. 10A illustrates a 3D view of a long tamper, according to an embodiment of the present invention.

FIG. 10A exemplarily illustrates perspective view of different embodiments of a tamper device or long penetrating tamper. The finishing tamper device comprises a shaft 140. In an embodiment, the shaft 140 comprises a first end and a second end. A generally hammer element 101 extends from the first end of the shaft 140 for receiving multiple impacts from the external vibratory hammer. The shaft 140 transfers the impact to a finishing head 141 positioned at the second end of the shaft 140 for compacting a top layer of the compacted aggregate pier to form a finished aggregate pier.

Figure 10B:
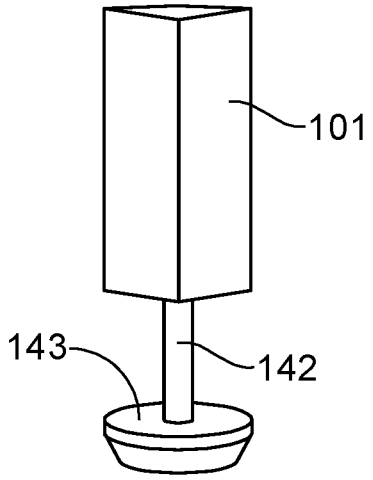
FIG. 10B illustrates a 3D view of a short tamper, according to an embodiment of the present invention.

FIG. 10B exemplarily illustrates perspective view of different embodiments of a finishing tamper device or short tamper. The finishing tamper device comprises a shaft 141. In an embodiment, the shaft 141 comprises a first end and a second end. A generally hammer element 101 extends from the first end of the shaft 141 for receiving multiple impacts from the external vibratory hammer. The shaft 141 transfers the impact to a finishing head 143 positioned at the second end of the shaft 141 for compacting a top layer of the compacted aggregate pier to form a finished aggregate pier. In an embodiment, the finishing head 142 is configured as a flat beveled tamper as exemplarily illustrated in FIG. 10B. In another embodiment, the finishing head 141 is configured as a cylindrical double beveled tamper as exemplarily illustrated in FIG. 10A.

Figures 11A, 11B, 11C, 11D:
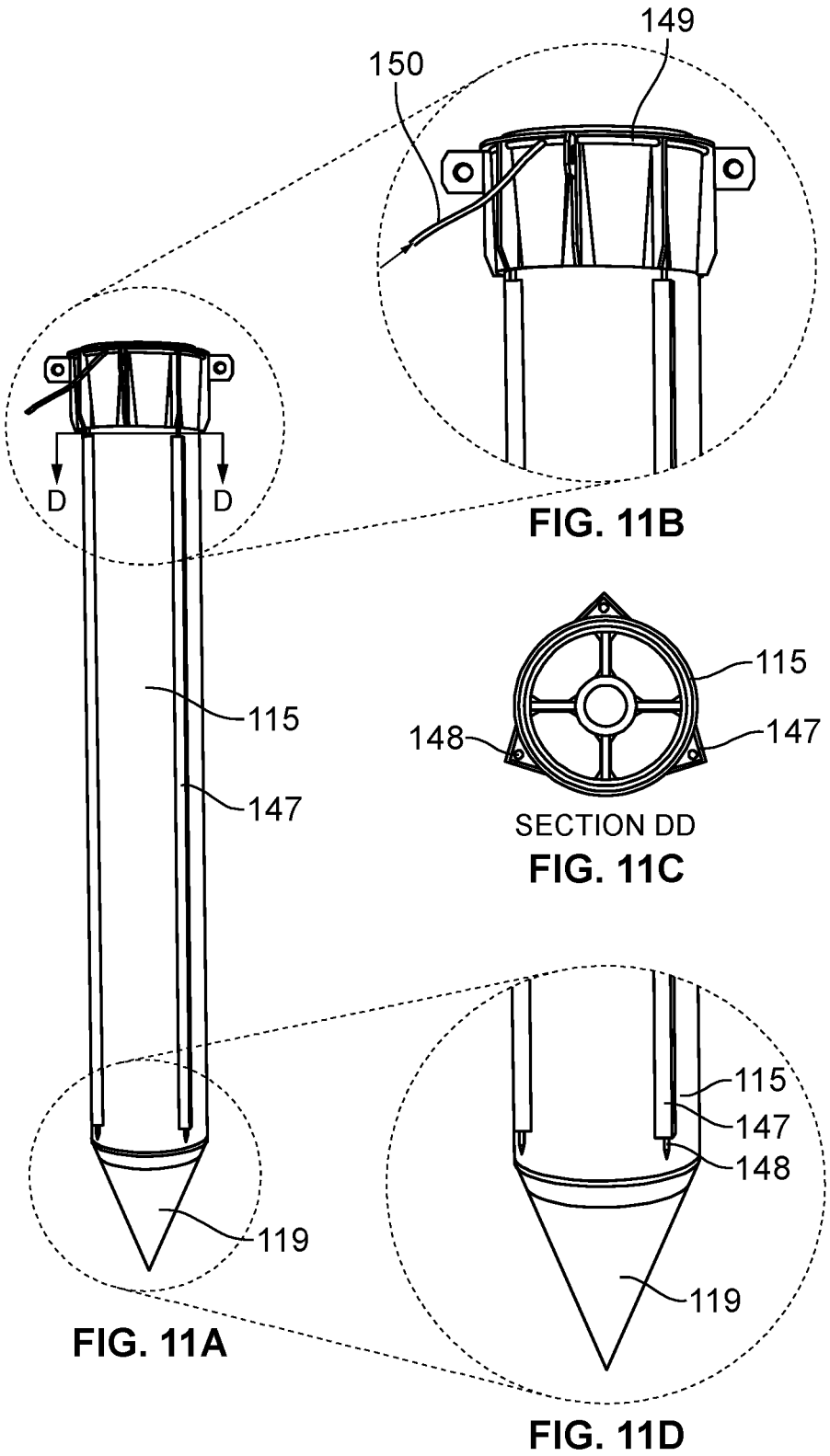
FIG. 11A illustrates a 3D view of a water jet system installed on the casing pipe of the mandrel, according to an embodiment of the present invention.
FIG. 11B illustrates an enlarged view of the water jet system in upper part of the casing of the mandrel, according to an embodiment of the present invention.
FIG. 11C illustrates an enlarged view of a D-D cross section of the casing of the mandrel, according to an embodiment of the present invention.
FIG. 11D illustrates an enlarged view of an end of the mandrel, according to an embodiment of the present invention.

FIG. 11A exemplarily illustrates a 3D view of water jet system installed on the casing 115 of the mandrel according to an embodiment of the present invention. Referring to FIG. 11A to FIG. 11D, a L-shaped steel section 147 is disposed at the exterior region of the casing 115. Referring to FIG. 11C to FIG. 11D, the L-shaped steel section 147 is configured to enclose a galvanized pipe 148 for pumping water to end nozzle. Referring to FIG. 11B, a curved galvanized pipe is connected to inlet of water pipe under pressure and the galvanized pipe 148.

Figure 12:
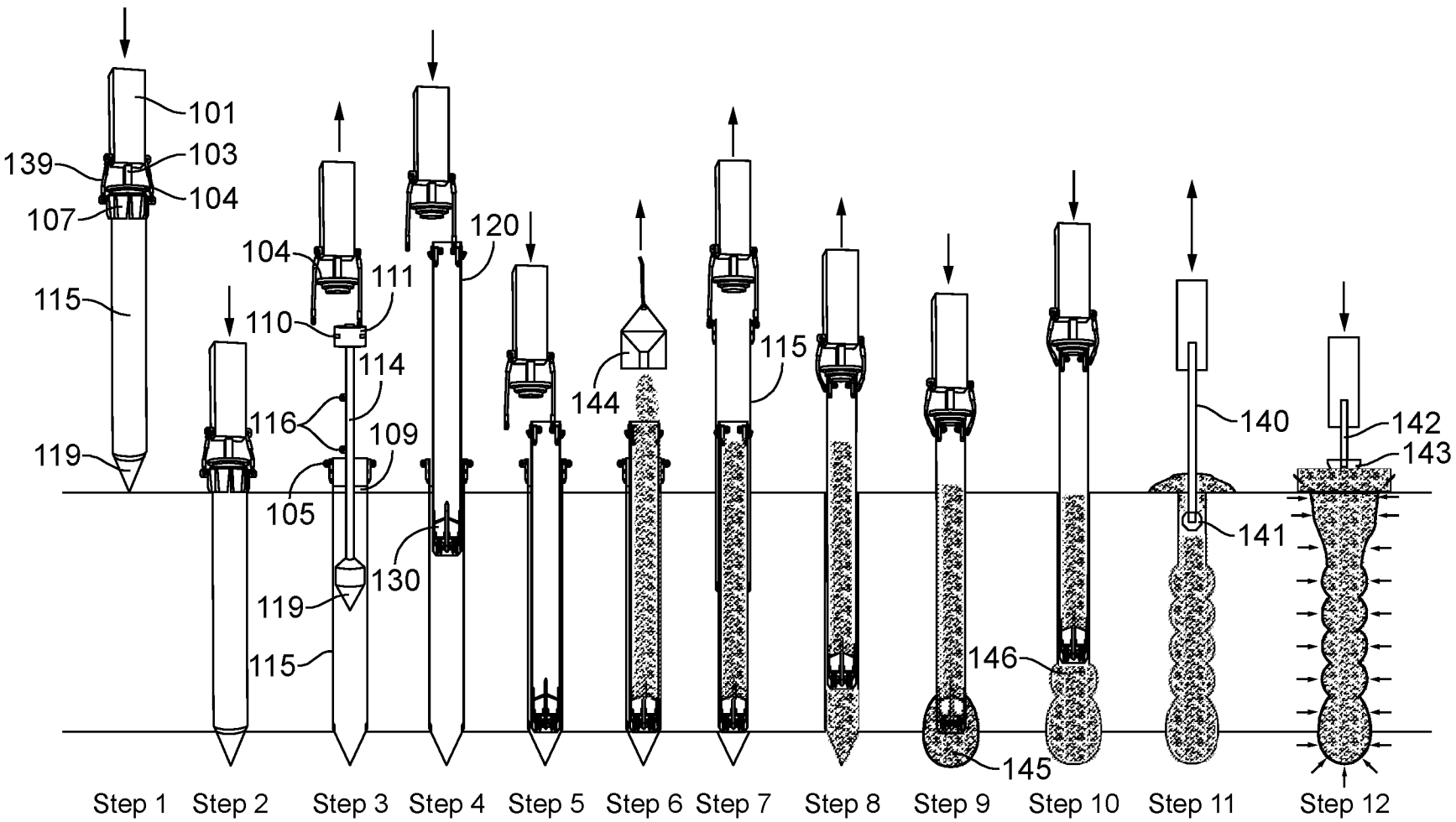
FIG. 12 illustrates a flowchart of a method for an aggregate impact compaction pier for forming a compacted aggregate pier at a target location, according to an embodiment of the present invention.

Referring to FIG. 12 illustrates method of soil radial compaction through the implementation aggregate impact compaction piers using an inner mandrel with two axials on a loose soil bed as a schematic diagram. The method comprises a step of: drilling a well manually with a diameter of about 60 cm and the depth of 60 cm at the base of the pier. The method further comprises a step of: placing the end of the mandrel in the well and hammering the mandrel into the soil bed to required depth by a hydraulic hammer mounted on a chain wheel excavator. The method further comprises a step of: removing the drive shaft 114 from inside of casing 115 of the mandrel.

The method further comprises a step of: placing the inner mandrel into casing 115 of the mandrel. The method further comprises a step of: filing the internal space of housing 120 of the inner mandrel with aggregate. The method further comprises a step of: removing the casing 115 of the mandrel. The method further comprises a step of: raising the housing 120 of the inner mandrel to a distance of 60-80 cm, opening the valves, discharging the aggregate at the bottom of well and repeatedly driving the inner mandrel simultaneous with closed valves for purpose of creating end resistant bulb.

The method further comprises a step of: making a compression shaft pier to a depth of about 1.5-2 meters from surface of ground by raising and repeatedly driving the inner mandrel in the range of 40-60 cm in order to form a compacted aggregate layer to medium thickness of 30 cm. The method further comprises a step of: feeding and repeatedly compacting the aggregate aggregates inside the well in upper part of the pier with a long tampering device shown in FIG. 10A. The method further comprises a step of: pouring a wide aggregate layer over zone of built aggregate piers and hammering the aggregate bed by the short tampering device shown in FIG. 10B.

In another embodiment, the method of forming gravel impact compaction piers is disclosed. The gravel impact compaction piers are made based on two mechanism: a) displacement, by creating a hole in the ground using the mandrel with close ended cone and the matrix soil radial density and b) replacement, by opening the end of the casing and filling it with gravel aggregates, then removing the pipe from the ground. in the case of the mandrel encountered with the dense sandy intermediate layer having low thickness during driving into the ground and it is not possible to cross through this layer and making gravel impact compaction piers especially under groundwater level, this invention is based on this main criteria: a) cross through dense sandy intermediate layer by installing water jet system on the mandrel, b) compacting the gravel as layered along the pier especially in the intermediate layer or lower half of the pier using automatic gravel compaction mandrel or inner mandrel instead of using long penetrating mandrel and c) removing the lock between the drive shaft 114 and the casing pipe 115 in the mandrel make it possible to solve the problem and facilitate the building of gravel impact compaction pier.

The technology and process of making gravel impact compaction piers system using an inner mandrel with two axials equipped with water jet system is designed and built to create and increase the radial compaction of loose soil layers under each level of groundwater especially in submerged coastal conditions and possibility of the existence of dense sandy intermediate layer. This technology increases the matrix soil radial density around the piers and thereby, retrofitting the loose soil against liquefaction and increasing the bearing capacity and the subgrade reaction modulus and reducing the settlement of the bed soil by making the gravel impact compaction pies in a square or triangular pattern.

The gravel impact compaction piers are one of the loose soil improvement methods using two mechanisms of displacement and replacement. For this purpose, different mandrel invented to making gravel impact compaction piers which differ in the type of technology and the effect of the matrix soil radial compaction.

In yet another embodiment, the general method for making the gravel impact compaction piers based on this technology is based on the four main steps: (a) the installation of the casing pipe into the ground without removing the soil inside it by driving the mandrel into the ground (including the casing pipe 115 and steel drive shaft 114 with a close ended cone) and removing the drive shaft 114 from the inside of the casing pipe 115 using by tamper attached to a hydraulic hammer mounted on a chain excavator, (b) filling at the bottom of the well by the open graded gravel, installing the inner mandrel into the casing pipe 115 and hammering the inner mandrel in order to form the bottom end resistant bulb of pier, (c) filling in the inner mandrel with gravel, (d) creating of end resistant bulb and the gravely shaft as layered from the bottom to a depth of 2 meters from the ground surface by frequently raising and lowering the mandrel and feeding and compacting the aggregates in the end well at each stage using the frequency impacts from rammer of mandrel that applied to the end of the inner mandrel, (e) filling the upper part of the well by gravel layer and depositing gravely aggregates on the pier and compacting the gravel layers and matrix soil around the pier due to the frequent driving of the long penetrating tamper and feeding the upper part of the well and implementation of a wide gravel layers on the ground surface and density if the bed using tamper device.

As a result, the use of new technology and the process of gravel impact compaction piers especially in submerged soils lead to: a) mandrel driving into the ground due to collision with the dense sandy intermediate layer does not stop and for crossing through that, no need to other excavation equipment such as mechanical auger, b) by feeding and repeatedly hammering of gravel as layered by the inner mandrel and possibility of creating (making) an end resistant bulb and a dense gravel shaft, a harder gravel compaction pier is produced, c) the matrix soil around the pier is compacted radially especially in dense sandy intermediate layer or lower half of the pier, and d) the amount of amortization of long penetrating tamper and hydraulic hammer are significantly decrease. Based on this, the radial compaction of matrix soil around the pier is done uniformly from the ground surface to the end of the pier that by which, the soil retrofitting against the liquefaction will have a higher safety factor. Also, the rate of increase in bearing capacity and the subgrade reaction modulus and reduction of settlement of composite base of soil-gravel piers, are more efficient.

The features and advantages of making gravel impact compaction piers using by inner mandrel with two axials are as follows: a) easy, fast and low costs of crossing of the outer mandrel through the hard intermediate layer due to the water jet system installed on the pipe of the mandrel, b) removable rotary locks between inner steel shaft and the casing pipe of the outer mandrel allows easy and fast exit of inner steel shaft from the inside of the casing pipe at the end of the penetration of mandrel into the bed, c) due to the use of an automatic soil compaction mandrel or inner mandrel, there is the possibility of feeding the compaction of gravel as layered and creating resistance end bulb and compacted shaft of the compaction pier especially in submerged conditions, d) increasing the radial compaction of matrix soil around the pier at the levels below the hard intermediate layer or lower half of the gravel pier especially in submerged conditions, e) increasing the elastic modulus, bearing capacity and subgrade reaction modulus and decreasing settlement of the top of piers due to hammering the gravel aggregates as layered by an automatic soil compaction mandrel, f) significant reduction of amortization of long penetrating tamper as compaction the lower gravel layers or below the hard intermediate layers by this tamper is not required, d) use of more weight of the inner mandrel in comparison to a long penetrating tamper for compaction of lower gravel layers, e) enables fast and economical making of the gravel impact compaction piers below the dense granular intermediate soil layers in submerged conditions.

Basically, the gravel impact compaction pier system in condition of loose granular soil or submerged especially in coastal areas, is an advantageous method having technical and economical justifications compared with other methods of making this type of piers. In practice, some geotechnical complications such as the existence of hard and dense intermediate layers can be a limitation factor in using this technology. In such cases that there are sequential loose and dense layers, although the use of mechanical auger can be a way to cross through hard layers, however, can lead to increased time and cost. On the other hand, by using the mechanical auger, the relative density of the soil bed will be greatly decreased due to discharge of the soil in the well. Based on this, if there are loose soils, there is no alternative method (way) to this problem.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

What is claimed is:

1. An aggregate impact compaction pier method for forming a compacted aggregate pier at a target location, comprising the step of:

providing an aggregate impact compaction pier system comprising, a mandrel comprising, a casing having a hollow cylindrical configuration, a drive shaft disposed within the casing comprises a first end and a second end, the first end comprises an inner ring mounted on the drive shaft and an outer cylinder connected to the inner ring via one or more plates, the first end detachably locks with the casing via a locking assembly, and the second end of the drive shaft is enclosed by a bore head, and a rammer element connected to a hammer element to transmit impact of the hammer element to the drive shaft, wherein the drive shaft is configured to drive the casing onto the target location to form a cavity;

an inner mandrel with a housing having a hollow cylindrical configuration, the housing comprises a first end and a second end, the first end is configured to detachably lock with the first end of the casing and the second end comprising an interior cylinder, the interior cylinder comprises a steel plate vertically extends across a length of the cylinder, a divider plates vertically extends from each side of the first plate to the cylinder and a valve disposed below the divider plates and extends horizontally across a passage from each side of the first plate dividing the cylinder into number of passages, wherein the valve disposed below the passages is configured open and close to control the flow of aggregate, and the inner mandrel is disposed within the casing after detaching the drive shaft to fill the housing with aggregate, the valve is configured to discharge the aggregate at the target location, and the inner mandrel is rammed with the hammer element after closing the valves for creating compacted aggregate layer, a tamper device for compacting the filled aggregate comprising a compacting shaft comprising a first end and a second end, a second hammer element extending from the first end of the compacting shaft for receiving multiple impacts from an external vibratory hammer and transferring the impact to a compaction head positioned at the second end of the compacting shaft for forming the compacted aggregate pier at the target location, and a finishing tamper device comprising a shaft, the shaft comprising a first end and a second end, a third hammer element extending from the first end of the shaft for receiving multiple impact from the external vibratory hammer and transferring the impact to a finishing head positioned at the second end of the shaft for compacting a top layer of the compacted aggregate pier to form a finished aggregate pier at the target location;

positioning the mandrel above the target location;

generating a cavity by driving the mandrel using an external vibratory hammer;

removing the drive shaft from the casing of the mandrel positioned in the cavity;

placing the inner mandrel into casing of the mandrel;

filing the hollow cylindrical configuration of the housing of the inner mandrel with aggregate;

removing the casing of the mandrel;

discharging the aggregate at the target location by raising the housing of the mandrel to a predefined distance and opening the valves;

driving the inner mandrel with the hammer element after closing the valves for creating an end resistant bulb;

repeating the step of discharging and driving to form a compacted aggregate layer of predefined thickness;

compacting the aggregate filled cavity at least once using the tamper device, and compacting a top layer of the compacted aggregate pier with the finishing tamper device to form a finished aggregate pier at the target location.

2. The method of claim 1, wherein an exterior surface of the casing comprises a L-shaped steel section enclose a galvanized pipe for pumping water to an end nozzle disposed at the casing.

3. The method of claim 1, further comprises one or more chains steel chains disposed below the valve to avoid soil bulking and closing of the valves and to help in opening of end valves.

4. The method of claim 1, further comprises one or more vertical steel plates is connected to the steel plate in order to hold the valve oblique and for ease of closure.

5. The method of claim 1, wherein the rammer element comprises a flat surface with a decreasing tapered form from top to bottom end.

6. The method of claim 1, wherein the bore head comprises at least one of a conical configuration and a pyramidal configuration.

7. The method of claim 1, wherein the target location is selected from a group consisting of a loose sandy soil, a clayey soil, a medium density soil, and a soil bed having hard rocks.

8. The method of claim 1, wherein the target location is selected from a group consisting of a loose sandy soil, a clayey soil, a medium density soil, and a soil bed having hard rocks.

* * * * *